United States Patent [19]

Eygret

[11] Patent Number: 5,033,439

[45] Date of Patent: Jul. 23, 1991

[54] INJECTION SUPPLY DEVICE FOR INTERNAL COMBUSTION ENGINE, WITH ELECTRONIC CONTROL

[75] Inventor: Daniel Eygret, Le Chesnay, France

[73] Assignee: Solex, Nanterre, France

[21] Appl. No.: 493,731

[22] Filed: Mar. 15, 1990

[30] Foreign Application Priority Data

Mar. 31, 1989 [FR] France ..... 89 04287

[51] Int. Cl.[5] ..... F02M 51/02; F02D 41/34

[52] U.S. Cl. ..... 123/491; 123/179 L

[58] Field of Search ..... 123/179 L, 491

[56] References Cited

U.S. PATENT DOCUMENTS

| | | | |
|---|---|---|---|
| 3,616,784 | 11/1971 | Barr | 123/491 |
| 3,628,510 | 12/1971 | Moulds et al. | 123/179 L |
| 4,200,063 | 4/1980 | Bowler | 123/478 |
| 4,463,732 | 8/1984 | Isobe et al. | 123/491 |
| 4,573,443 | 3/1986 | Watanabe et al. | 123/492 |
| 4,683,859 | 8/1987 | Tamura et al. | 123/179 L |
| 4,719,885 | 1/1988 | Nagano et al. | 123/491 |
| 4,724,816 | 2/1988 | Kanno et al. | 123/491 |

FOREIGN PATENT DOCUMENTS

| | | | |
|---|---|---|---|
| 2332431 | 6/1977 | France . | |
| 0135332 | 8/1983 | Japan | 123/179 L |

*Primary Examiner*—Tony M. Argenbright
*Assistant Examiner*—Robert E. Mates
*Attorney, Agent, or Firm*—Larson & Taylor

[57] ABSTRACT

A fuel supply device for an internal combustion engine comprises at least one electrically controlled injector feeding fuel under pressure into the intake manifold of the engine and an electronic control circuit connected to sensors responsive to operating parameters of the engine, particularly the engine speed, and delivering periodic signals of variable duty ratio to the injector. The control circuit applies asynchronous electrical signals to the injector as long as the running speed of the engine does not reach a predetermined threshold value. The asynchronous signals have a frequency very much higher than that which the synchronous operative law would cause.

8 Claims, 3 Drawing Sheets

INJECTION SUPPLY DEVICE FOR INTERNAL COMBUSTION ENGINE, WITH ELECTRONIC CONTROL

BACKGROUND OF THE INVENTION

1. Technical Field

The invention relates to fuel supply devices for internal combustion engines of the kind comprising at least one electrically controlled injector feeding fuel under pressure into the intake manifold of the engine and an electronic control circuit connected to sensors responsive to operating parameters of the engine, particularly the engine speed, and delivering periodic signals of variable duty ratio to the injector.

The invention applies to all so-called indirect injection devices, namely those feeding fuel into the intake manifold of the engine (and not directly into the combustion chambers). The injection may be monopoint, i.e. with a single injector which sprays the fuel at a single point of the manifold, situated upstream of a restriction member; the invention applies to this case but it is particularly advantageous in the case of multipoint injection, provided by several injectors controlled either all simultaneously, or in groups, or else individually, and each opening into a branch of the manifold upstream of a respective intake valve.

2. Prior Art

As a general rule, indirect injection devices have an operation termed "synchronous" during the periods when the engine is operating under steady conditions. A given injector is actuated when the shaft of the engine is in a given angular position In the case of multipoint injection, by injectors controlled individually or in groups, the different injectors (or the different groups) are generally controlled with a relative phase offset, so as to limit the variations of the fuel supply pressure.

The electronic control circuits for the injection device must be designed to ensure satisfactory operation during transitory operating phases. For example, it has already been proposed to replace synchronous injection with asynchronous injection for supplying the motor with additional fuel it needs during acceleration (U.S. Pat. No. 4,573,443). It has also been proposed to substitute synchronous operation with asynchronous operation when the operating parameters of the engine lead to control pulses of the injectors which are considered too weak in the case of synchronous injection (U.S. Pat. No. 4,200,063).

The invention is intended to solve a different problem, that of starting up the engine and, possibly, operating during heating of an initially cold engine, which requires increasing the amount of fuel delivered to the engine. Different solutions have already been proposed. In particular, an additional cold start injector has been used which sprays pressurized fuel very finely into the manifold: this solution requires an addition injector and a considerable fraction of the sprayed fuel wets the walls of the intake manifold, which is unfavorable, especially when the temperature is very low and when the fuel remains as adhering droplets. A more advantageous solution consists, during the starting phase, in continuously injecting low pressure fuel into the manifold (French Patent No. 2,332,431). But even when the fuel jet is thrown directly onto the stems of the intake valves so as to cause it to break up, fuel fractionation may remain insufficient.

U.S. Pat. No. 3,628,510 discloses a fuel injection system having an analog control circuit, which consequently does not include digital storing means. During starting, the control circuit adds supplemental energizing pulses to the regular synchronous pulses, for increasing the amount of fuel delivered to the engine. Spraying is consequently not improved.

SUMMARY OF THE INVENTION

An object of the invention is to provide a device of the above-defined kind which better fulfils the requirements of practice than those known at present time, particularly in that it facilitates start-up of the engine when the engine is driven at slow speed by the starting motor, which would cause synchronous operation to take place at a low and irregular frequency.

The invention is based then on the finding that, when an electromagnetically controlled injector closes, there occurs a particularly intense fractionation or spraying of the fuel jet passing through the injector. Consequently, in a device according to the invention the electronic control circuit is constructed so as to apply to the injector or to each injector asynchronous electrical signals of a frequency very much higher than that which the synchronous operating law would cause, as long as the running speed of the engine does not reach a given threshold value.

"Very much higher" is to be construed as greater by at least one order of magnitude.

With this arrangement, the number of closures of the injector per unit time is very much increased. In practice, it is desirable to reach a number of opening and closing cycles as high as possible to the extent that this number is compatible with a sufficient flow rate of the injector and with the minimum cycle time. In practice, a cycle time (opening time plus closure time) will typically be adopted not exceeding 60 ms.

Due to the increased cycle frequency, spraying is improved and satisfactory starting of the engine may be obtained with a lesser amount of fuel, which, among other consequences, reduces pollution considerably.

As a general rule, it will be necessary to limit the time duration of the above-defined asynchronous injection, particularly to avoid "flooding" the engine. The maximum duration of the above-described asynchronous operation is advantageously a decreasing function of the temperature of the engine. The cycle time duration and the duty ratio of the injector (or injectors) may also be controlled as a function of operating parameters of the engine, and particularly of the temperature of the cooling liquid. The values to be given to the duty ratio, to the injection cycle time duration and to the maximum duration of asynchronous injection can typically be stored in the form of tables in a ROM.

The invention will be better understood from the following description of a particular embodiment, given by way of non-limitative example.

DETAILED DESCRIPTION OF A PREFERRED EMBODIMENT

Figure 1:
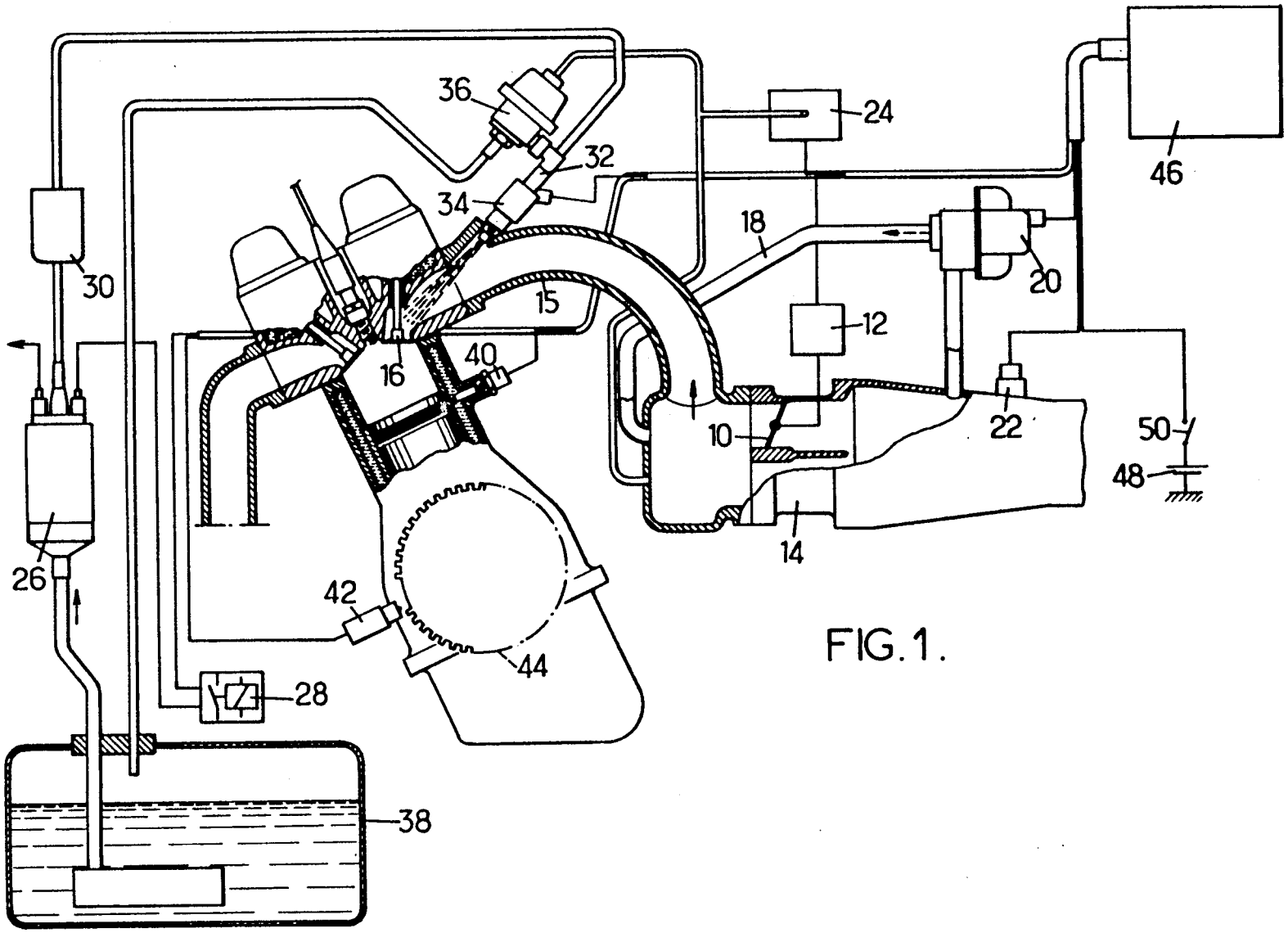
FIG. 1 is a schematic diagram showing a multipoint injection device to which the invention is applicable.
Figure 2:
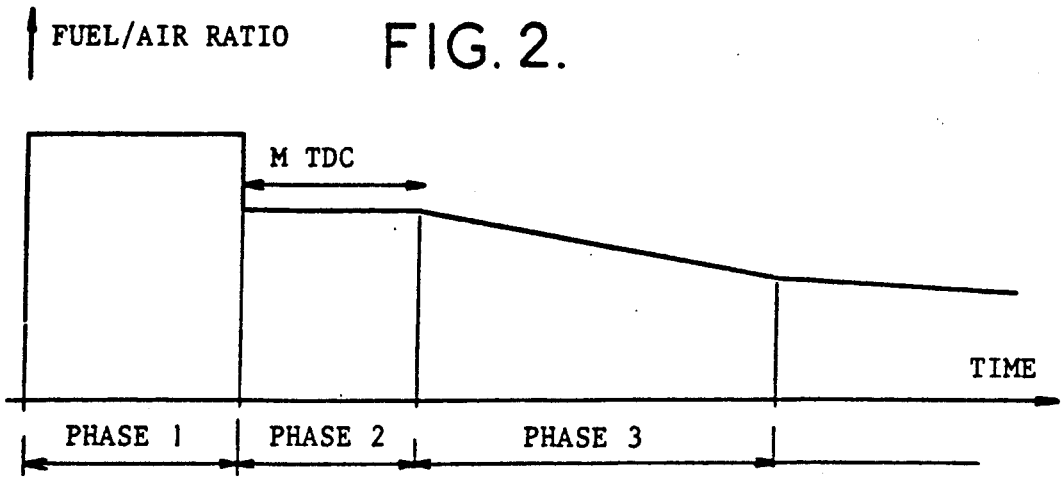
FIG. 2 is a diagram showing the successive phases of a typical starting sequence, using a device according to the invention.

The multipoint injection device shown in FIG. 1 has a general construction which is well known. It comprises an air supply circuit in which is inserted throttle member 10 controlled by the driver and having an aperture sensor 12 delivering an electric output signal representative of the opening angle of the throttle member. In most cases, the throttle member is mounted in a block called "butterfly valve body" 14 which may contain two simultaneously controlled throttle members. The airpath comprises, downstream of body 14, a manifold 15 with several branches each opening upstream of the intake valve of a combustion chamber of the engine.

In the illustrated embodiment, an additional air line 18 with an electrically controlled valve 20 leads bypassing the butterfly valve body 14 into the manifold air during certain operating phases and particularly during start-up, when throttle member 10 is closed.

As show, the device further comprises:

an air temperature probe 22 delivering an electric signal representative of the temperature of the air reaching the butterfly valve body;

a sensor 24 monitoring the air pressure in manifold 15 and delivering a signal which, combined with that from the aperture sensor 12 or with a signal indicating the speed of the engine, enables to compute the flow rate of air entering the engine.

Sensors 12 and 24 may be replaced with an element measuring the flow rate directly.

A fuel supply circuit comprises an electric pump 26, controlled by a relay 28 which is energized when the ignition contact 50 is closed. Pump 26 feeds, through a filter 30 and a distribution line 32, the injectors 34 (only one of which being shown) which are disposed immediately upstream of the respective intake valves 16. The pressure of the fuel fed to the injectors is maintained, by a pressure regulator 36 having a return pipe to reservoir 38, at a value which may be fixed or may depend on the pressure prevailing in the manifold, measured by sensor 24.

The device shown in FIG. 1 further comprises sensors responsive to additional operating parameters, comprising:

a cooling liquid temperature probe 40, an engine speed and position sensor, consisting of a sensor 42 delivering an electric pulse whenever a tooth of the engine ring 44 passes before it, the ring having a gap for detecting a given angular position of the ring, if required, a probe (not shown) for measuring the oxygen content in the exhaust manifold, when the device is provided for "looped" regulation.

The injectors are energized by an electronic circuit 46 fed by the battery 48 as soon as the ignition contact 50 is closed. The electronic circuit delivers electric control signals in the form of square wave pulses, having an adjustable duty ratio to injectors 34. In the embodiment shown, it receives electrical input signals representative of:

the temperature $\theta 1$ of the cooling liquid of the engine, delivered by probe 40, the air temperature $\theta a$, delivered by probe 22, the opening angle $\alpha$ of the butterfly valve, i.e. of the throttle member, delivered by sensor 12, the speed of the engine, in the form of a series of variable frequency pulses, delivered by sensor 42, the absolute pressure in the manifold, delivered by sensor 24.

The operation of the engine under steady operating conditions will not be described here, for it may be conventional. During this operating phase the electronic circuit 46 delivers to each injector 34 an opening pulse synchronized with the actuation of the corresponding intake valve 16 and having a duration depending on the operating parameters, and particularly on the air flow metered by the throttle member 10. The law of variation of the duration of each control pulse responsive to the parameter values is fixed by a program stored in a ROM in circuit 46.

In accordance with an aspect the invention, device 46 contains a cold start program, also stored in a ROM or in wired form, which causes operation in three successive phases, the last two being possibly omitted when the engine is started up while it is at its normal operating temperature.

Phase begins as soon as the engine is driven by the starter motor (start being indicated by the signals of sensor 42 or the energization of the starter motor) and ceases:

when the running speed N of the engine reaches a predetermined value $N_O$ indicating that the engine is self-sustaining (generally between 200 and 400 rpm), or at the end of a given time interval chosen so as to avoid flooding the engine should start-up fail, this duration being fixed (5 s for example) or depending on the temperature of the cooling liquid, the shortest duration being taken into consideration.

Figure 4:
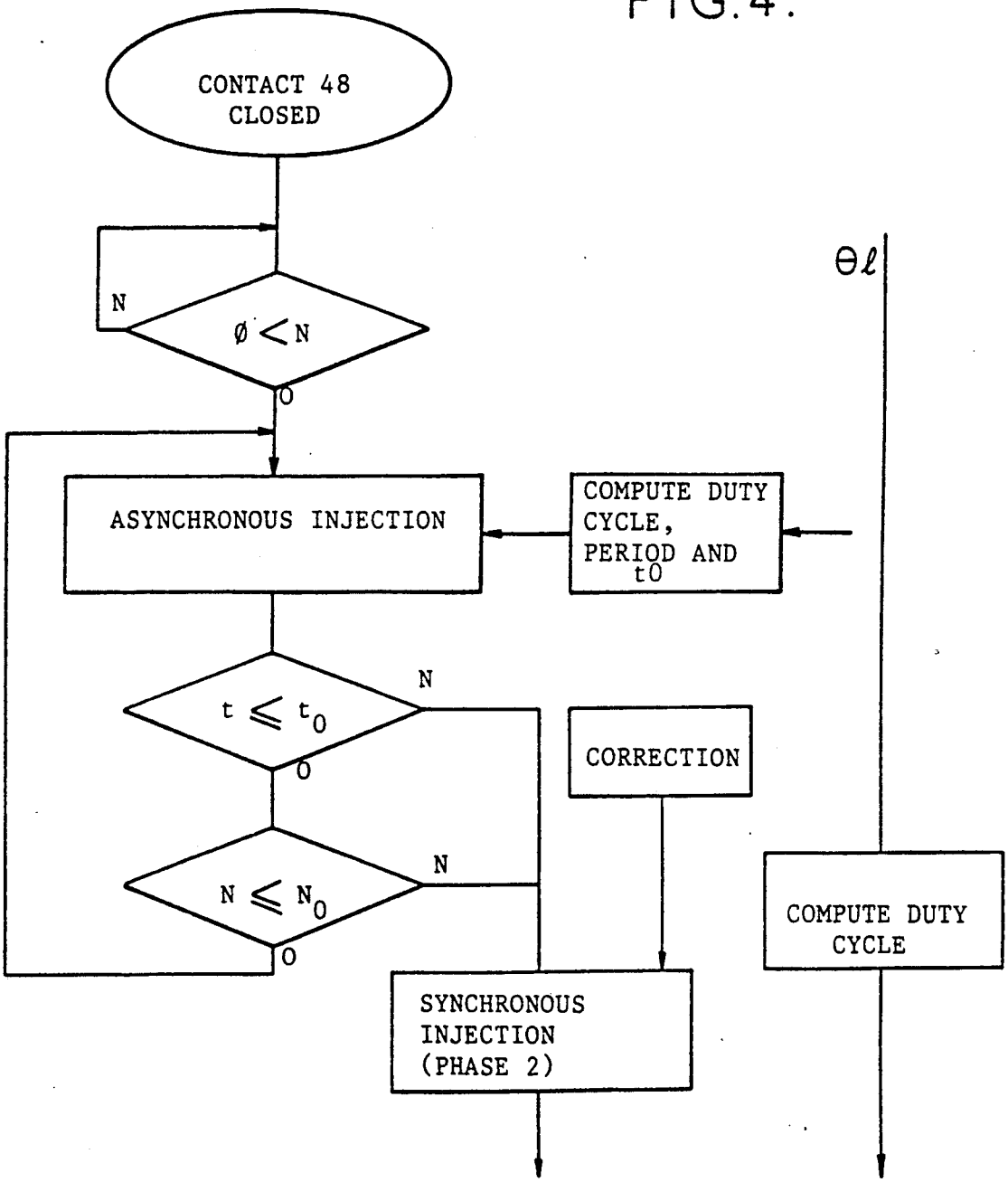
FIG. 4 is a schematic flow chart of the process.

The program stored in circuit 46, shown schematically in FIG. 4, must prevent return to phase I after passing over to phase II or III, except upon a complete reinitialization, implying that the engine has come to rest in the interval.

A solution which at the same time adapts the injection time durations to the initial condition of the engine and retains a simple construction of circuit 46, consists in arranging circuit 46 so that it delivers rectangular signals in phase I:

having a time duration selected among a few values only, and selected solely responsive to the initial temperature $\theta 1$, and whose repetition period is equal to n times a basic time period of about 8 ms, n also only assuming a few values.

The duty ratio will be chosen greater if $\theta 1$ is lower and a longer repetition period will be adopted for the lowest values of $\theta 1$.

By way of example, the values of the Table below may be adopted (the injection time, repetition period and the maximum duration which are selected being those corresponding, in the Table, to the value of $\theta 1$ closest to the measured temperature).

| $\theta 1$ (°C.) | Injection time | Recurrence period | Maximum duration $t_0$ of phase I |
|---|---|---|---|
| −30 (and below) | 32 ms | 48 ms | 4,0 s |
| −20 | 32 ms | 48 ms | 2,6 s |
| −10 | 24 ms | 48 ms | 2,0 s |
| 0 | 16 ms | 48 ms | 1,5 s |
| 10 | 8 ms | 32 ms | 1,1 s |
| 20 | 6 ms | 32 ms | 0,7 s |
| 30 | 5,75 ms | 32 ms | 0,6 s |
| 40 | 5,75 ms | 32 ms | 0,6 s |
| 50 | 5,0 ms | 32 ms | 0,5 |
| 60 | 4 ms | 32 ms | 0,5 s |

-continued

| θ1 (°C.) | Injection time | Recurrence period | Maximum duration $t_0$ of phase I |
|---|---|---|---|
| 70 | 3 ms | 32 ms | 0,5 s |
| 80 (and above) | 2 ms | 32 ms | 0,5 s |

To unflood the engine in the case of an aborted start-up due to excess fuel, circuit 46 may be adapted for replacing asynchronous injection with synchronous regular operation injection if the throttle member 10 is brought to its fully open position, which is detected by sensor 12.

Figure 3:
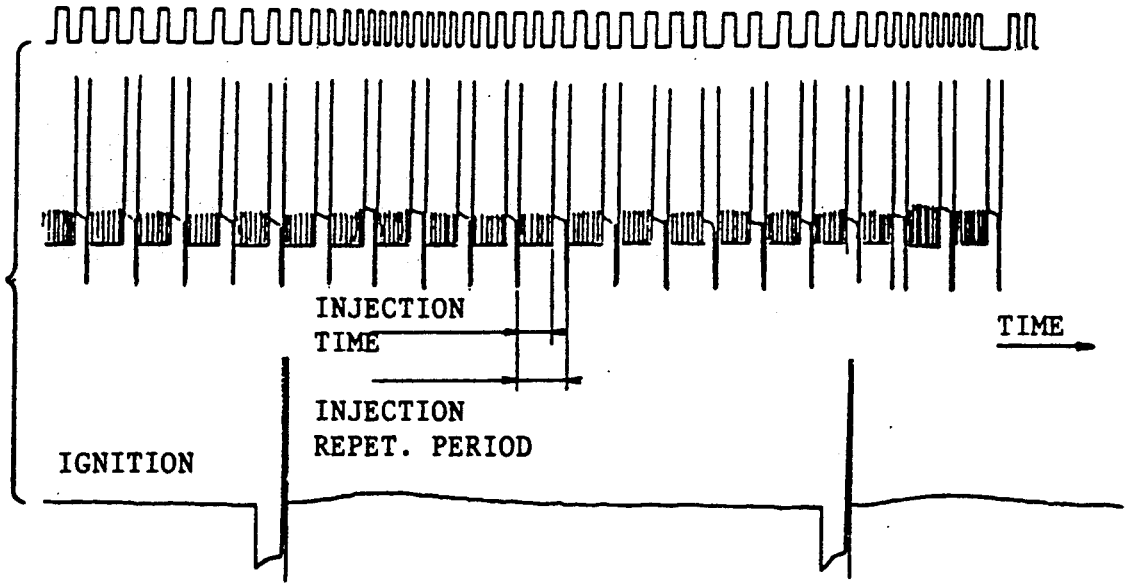
FIG. 3 is a diagram showing the successive injection instants, during the phase in which injection is asynchronous.

FIG. 3 shows, by way of example, a possible distribution time of the injections, at a constant repetition frequency (second line), with respect to the signals (first line) delivered by sensor 42 and whose frequency is variable because of the running irregularities of the engine during start-up. The ignition times (third line from the top) remain synchronized with the rotation of the engine shaft.

Start of phase II begins when the engine reaches a speed indicating that it is self-operating or at the end of a given time. It lasts for a predetermined number of operating cycles of the engine or, which is equivalent, until the engine has passed through top dead center M successive times (M being a predetermined integer).

During phase II, injection is synchronous but the duration of each injection is equal to the injection time resulting from the calculation made by circuit 46 for permanent operating conditions at the temperature of the engine (generally less than the normal operating temperature), with a multiplicative or additive correction.

The method of determining the "basic time", namely the duration of each synchronous injection as a function of θ1 during heating, will be described further on.

The number M of cycles may be chosen particularly responsive to the characteristics of each type of engine: a duration between 0 cycle (certain engines lending themselves to operation without phase II) and 255 cycles will generally give good results. During phase II, the multiplicative or additive correction will be maintained at a constant value. If a multiplying coefficient, it will generally be between 1 and 3.

Phase III begins at the end of phase II. During this phase, circuit 46 decreases the multiplicative or additive correction, in accordance with a law which is linear or approximately linear, as a function of the number of engine cycles. A solution which often gives good results consists in decrementing the correction by 1/256 of its original value at each cycle, until it is cancelled out.

Phase III ends when the multiplicative correction becomes equal to 1 or the additive correction becomes equal to 0.

From this time, circuit 46 resumes a conventional type operation, involving enrichment with respect to the stoichiometric fuel/air ratio which is a decreasing function of the temperature, or varies in inverse proportion to the temperature.

Beyond phase III, in order to operate correctly when idling, the engine must again receive an air/fuel mixture flow rate greater than the flow required for idling at normal operating temperature. In addition, this mixture must be fuel enriched as compared with the stoechiometric ratio. Numerous laws of selection are already known for selecting the flow rate and the air/fuel ratio corresponding to particular engines.

In practice, the increase of the amount of air/fuel mixture delivered to the engine will be obtained by opening valve 20 which by-passes the butterfly valve block, the electronic control circuit automatically adapting the flow rate of injected fuel to the air flow rate, with a degree of fuel enrichment fixed for example by a mapping table giving, for each engine temperature, a particular fuel/air ratio.

I claim:

1. A fuel supply device for an internal combustion engine comprising:

at least one electrically controlled fuel injector arranged for feeding fuel under pressure into intake means of the engine when electrically energized; and means for delivering electrical energization pulses to said injector, having a plurality of sensors providing electric signals representative of values of operating parameters of the engine including the running speed and the temperature thereof and an electronic control circuit having inputs connected to receive said electric signals, including means for applying to said injector periodic electric energization signals which are synchronized with operation of the engine, have a rate proportional to the running speed of said engine and have a duty ratio which is varied responsive to said operating parameters and means for substituting said synchronized energization signals with signals which are non-synchronous with the engine until the running speed of the engine has reached a predetermined threshold value indicating that the engine is self operative, said non-synchronous signals having a rate higher by at least one order of magnitude than the rate of said synchronous signal at the same running speed, said substituting means including a non-volatile memory storing a table providing the values of the frequency and of the duty ratio of said non-synchronous signals as a function of the electric signal representative of the temperature of the engine.

2. A device according to claim 1, wherein the non-synchronous signals have a repetition period of about 60 ms.

3. A device according to claim 1, wherein said threshold value is of from 200 to 400 rpm.

4. A device according to claim 1, wherein said electronic circuit is arranged to further limit the time duration of non-synchronous injection to a value which is in inverse relation to the temperature of the engine.

5. A device according to claim 4, wherein the electronic circuit is arranged to apply to the injectors, during a temporary phase for a predetermined number of operating cycles of the engine, after the end of said non-synchronous injection, adjusted synchronous injection signals, each injection signal during said temporary phase having a duration derived from the regular duration at the current temperature of the engine modified by multiplying said regular time duration with a predetermined coefficient greater than 1.

6. A device according to claim 5, wherein said electronic circuit is arranged to apply to the injectors, during a third phase after said temporary phase, synchronous injection signals modified by a multiplying coefficient which is progressively decreased to one upon increase of the number of operating cycles of the engine.

7. A device according to claim 4, wherein the electronic circuit is arranged to apply to the injectors, during a temporary phase for a predetermined number of operating cycles of the engine, after the end of said non-synchronous injection, adjusted synchronous injection signals, each injection signal during said temporary phase having a duration derived from the regular duration at the current temperature of the engine modified by adding a predetermined duration to said regular time duration.

8. A device according to claim 7, wherein said electronic circuit is arranged to apply to the injectors, during a third phase after said temporary phase, synchronous injection signals modified by said predetermined duration which is progressively decreased to zero upon increase of the number of operating cycles of the engine.

* * * * *